US006129083A

United States Patent [19]

Jansen

[11] Patent Number: 6,129,083

[45] Date of Patent: Oct. 10, 2000

[54] HOLDER FOR A COVERING OR THE LIKE FOR THE PUBIC AREA

[76] Inventor: Adelbertus Gabriel Jansen, Hogewoerd 18, 2311 HM Leiden, Netherlands

[21] Appl. No.: 09/060,057

[22] Filed: Apr. 15, 1998

Related U.S. Application Data

[63] Continuation of application No. 08/201,317, Feb. 24, 1994, abandoned.

[51] Int. Cl.[7] ..... A61F 5/37

[52] U.S. Cl. ..... 128/846; 128/885; 128/DIG. 25

[58] Field of Search ..... 128/845, 846, 128/885, 886, DIG. 25; 600/38

[56] References Cited

U.S. PATENT DOCUMENTS

| | | | |
|---|---|---|---|
| 1,328,176 | 1/1920 | Murtinka | 128/885 |
| 1,410,339 | 3/1922 | Murtinka | 128/885 |
| 2,534,934 | 12/1950 | Viniegra | 128/846 |
| 2,891,539 | 6/1959 | Hofer | 128/846 |
| 4,290,420 | 9/1981 | Manetta | 128/DIG. 25 |

*Primary Examiner*—Michael A. Brown

*Attorney, Agent, or Firm*—Smith Gambrell & Russell, LLP

[57] ABSTRACT

Device (1) for holding a covering (12) in front of the pubic area of a user, for example a textile covering such as a tanga, comprising a bracket (2) for engaging the groin area of the user on either side of the pubic area and the os sacrum and for supporting a covering, and securing means (4) which can be brought into securing engagement with the proximal side of the sphincter of the user so as to thereby be secured into place, wherein the securing means are substantially rigidly connected to the bracket.

39 Claims, 1 Drawing Sheet

HOLDER FOR A COVERING OR THE LIKE FOR THE PUBIC AREA

REFERENCE TO RELATED APPLICATION

Figure 1:
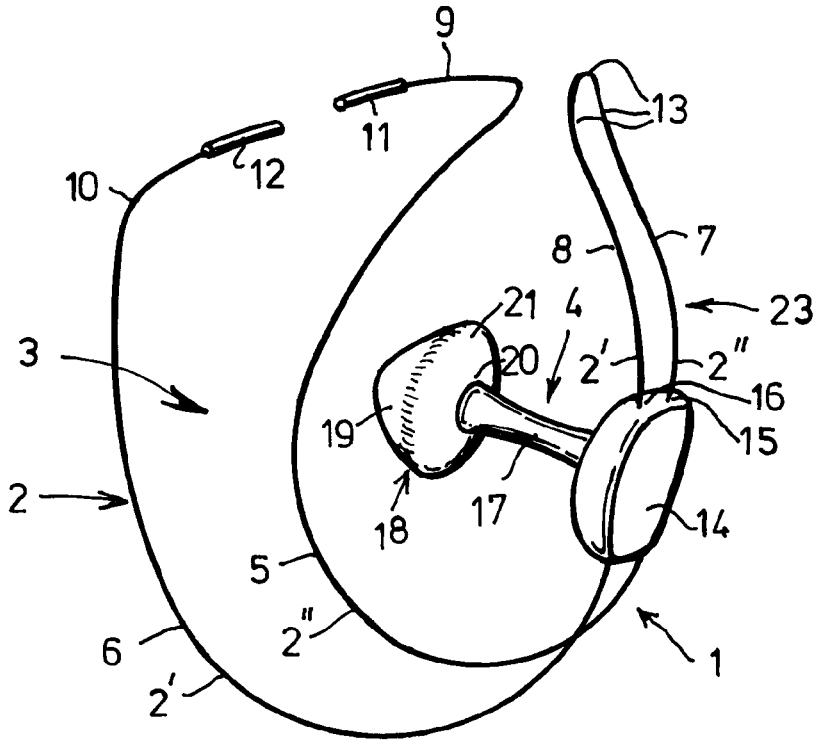

This is a continuation of U.S. patent application Ser. No. 08/201,317, filed Feb. 24, 1994, now abandoned.

The invention relates to a holder for a covering or the like for the pubic area of a user, for example a textile covering such as a tanga.

Normally briefs are used for covering the pubic area. These are characterized by a piece of fabric covering the buttock area, a piece of fabric covering the pubic area and more or less wide strips of fabric which connect these two together. Although as a rule such garments remain well in place on the user's body during a variety of activities, they have the disadvantage that for reasons of a normative nature a larger area of the user's body than is strictly necessary is covered and is not for example accessible for sunrays.

An improvement on this is the tanga, a common type of contemporary beach clothing in which the previously mentioned wide strips of fabric guided over the user's sides are replaced by thin straps or the portion covering the buttock area is absent and the portion covering the pubic area is held in position by means of straps guided through the anal cleft and around the user's sides. Although here the covered surfaces protected from the sun rays are relatively small, the tanga still has the disadvantage that after sunbathing stripes can be visible on the skin, particularly on the side. Apart from that in the case of male users it is only with difficulty that the tanga retains its close fit, because the portion covering the pubic area is only held in place by the straps, which merely exert a laterally directed force on that portion.

Furthermore, tanga-like garments are known with a spring-like bracket and a piece of fabric placed thereover, the bracket being held in position by engaging about the mons veneris with a triangular shaped bracket part at the front and by engaging in the anal cleft at the back. By means of this garment, that is particularly intended for women, the user's sides are thus freed from covering fabric parts. A disadvantage of this is, however, that the attachment to the user's body is not secure. Because of this, in particular in the case of female users, the bracket can start sliding laterally or, as a consequence of the user bending down, whereby the abdomen exerts a displacing pressure on the bracket, in a downward direction, as a result of which the pubic area may then become partially exposed.

An object of the invention is to provide a holder of the kind mentioned in the preamble, which can leave the user's sides completely exposed, but still can be held in a very secure and pleasant way against the user's body, in just about all the user's postures, so that not only a tanga, but also other coverings or objects remain well in position.

For this purpose the invention provides a device for holding a covering, cover or other objects in front of the pubic area of a user, for example a textile covering such as a tanga, comprising carrier means for engaging the groin area of the user, on either side of the pubic area, and for supporting a cover and securing means which can be brought into a securing engagagement with the proximal side of the sphincter of the user so as to thereby be secured into place, wherein the securing means are substantially rigidly connected to the first carrier means. The sphincter ensures that the securing means are held securely in place and with them also the first carrier means, so that the covering of the pubic area also can constantly remain in position. An additional advantage is that the device according to the invention is not essentially dependant on the clamping forces on the body exerted by the bracket as far as the operation is concerned, which can be highly unpleasant, but, on the contrary, because of the presence of the securing means in the rectum, will be experienced as being particularly pleasant.

Preferably, at the position of the securing means the first carrier means connect to second carrier means which are joined with the first carrier means and are designed for the engagement of the area of the anal cleft near the os coccygis, the second carrier means preferably comprising portions for the engagement of the area near the os sacrum. Preferably, the second carrier means are connected to the securing means in a substantially rigid way. In this way the device according to the invention is held in position in an especially secure manner, the securing means being moreover almost fixed in their position as seen in the symetrical plane of the user.

According to an advantageous further development of the device according to the invention the first carrier means and/or the second carrier means are elastically deformable in the symetrical plane of the user. This ensures that the first carrier means and possibly the second carrier means rest tightly on the user's body in order to provide a good fit for the covering, it being observed that due to the presence of the securing means this clamping force need not be so large that by this means alone the device according to the invention would remain in place on the user's body.

According to a preferred embodiment of the device according to the invention the first carrier means comprises two rod shaped parts extending on either side of the pubic area, which can be biassed in a direction turned away from each other, i.e. in a lateral direction. This ensures that in a lateral direction the covering will also be nice and tight. The first carrier means and the second carrier means are preferably integral with one another, and preferably form a bracket, made of wire e.g. metal wire. This bracket may be easily made, that is out of a single metal wire, of which the middle forms the outer end of the second carrier means and the ends form the ends of the first carrier means. A textile covering, for example, can simply be arranged on the bracket.

Preferably the securing means comprise a base attached to the first carrier means, a head part, provided with surfaces engaging the proximal side of the sphincter, and a shaft connecting the head part with the base. The head part thereof is provided with surfaces for indirectly pressing against the prostrate gland via the rectum wall and/or is provided with surfaces for indirectly presssing against the musculus levator ani. Through this the previously mentioned pleasant sensation that the user will have when wearing the device according to the invention will be heightened. This sensation will be enhanced even more in the case of the first and/or second carrier means being elastically deformable in the symmetrical plane of the user, in that the head part then, possibly after selection, presses against the prostrate gland or the musculus levator ani, which goes around the rectum on the dorsal side to the cavitas peritonealis. In this last case it has been been noticed that the user has the tendency to walk in an upright manner, as a result of which the aesthetic effect of the device according to the invention will be further heigtened.

Preferably the device according to the invention is designed in such a way that the first carrier means and/or the second carrier means can press against areas of the body which can be of use in acupuncture, particularly the groin area.

Figure 2:
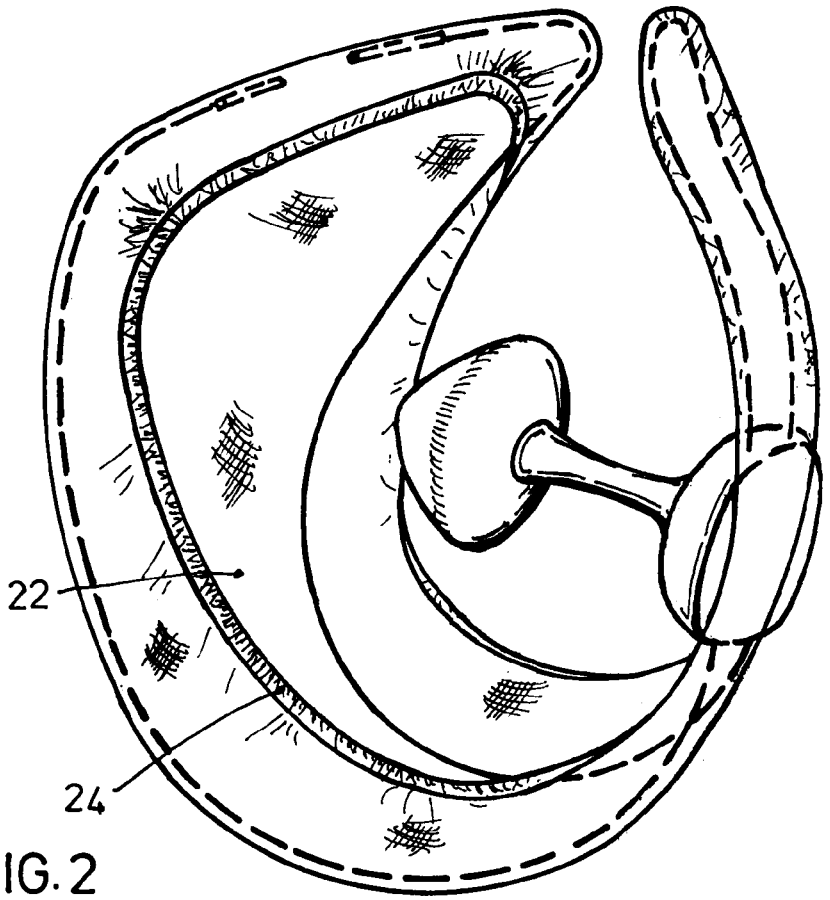

The invention will now be described on the basis of a preferred purely exemplary embodiment represented in the accompanying drawings. In the drawings:

FIG. 1 shows the preferred embodiment of the device according to the invention in perspective view, without textile covering; and FIG. 2 shows the device according to FIG. 1, on a somewhat enlarged scale, with textile covering.

The device 1 according to the invention is substantially made up of a bracket 2 of synthetic material or (stainless) metal and a pawn shaped securing part 4. The bracket 2 is formed from a single wire, bent double in the middle so as to form two bracket legs 2' and 2". The bracket legs 2' and 2" define a rear bracket portion 23 and a front bracket portion 3, which merge into one another at the position of the securing part 4. In the first bracket portion 3 the bracket legs 2', 2" define wire portions 5, 6 which are intended to rest against the groin area on either side of the pubic area of the user. At their upper end the wire portions 5, 6 are bent towards each other in order to form more or less horizontal wire portions 9, 10, on the ends of which protective caps 11, 12 are attached to protect the user against the sharp ends of the wire portions 9 and 10. In the rear bracket portion 23 the bracket legs 2', 2" form wire portions 7, 8 that are in such close proximity to one another that they can both reach up through the anal cleft of the user so as to be able to engage about the os sacrum with their portion 13.

The pawn shaped securing part 4 substantially comprises a base 14, which is provided with passages 15, 16, for the passage of the bracket legs 2', 21". In order to adjust the device according to the invention to suit the user, the bracket legs 2', 2" are slidably accomodated in the base 14, and restrained as it were therein. After the user has found the correct position, the position of the base 14 with regard to the bracket legs 2', 21" can be fixed with the help of a suitable adhesive (not shown). The pawn shaped securing means 4 further comprises a head part 18 which is connected to the base 14 by means of a shaft 17. Here this shaft is rod shaped but can also be made by a more plate shaped body. The securing part 4 is preferably made of an integral piece of wood, porcelain, metal, rubber, synthetic material or any other such suitable material and is provided with a smooth surface. The head part 18 projects from the the shaft 17, as seen in a radial direction from the shaft, and thereby forms on the side facing the base a locking or stop surface 20 which is intended to rest against the proximal side of the sphincter during use. In order to be able to permit an easy insertion of the securing means 4 the front side of the head part 18 is so made that it is conical and rounded off. In the areas thereof which are forewardly and downwardly faced, in the position of use, surfaces 19 are formed, which, in the case of male users, are intended to press against the prostrate gland indirectly via the rectum wall. At the rear side of the head part 18, at the top, the locking surface 20 forms a surface 21 which is intended during use to press against the musculus levator ani indirectly via the rectum wall.

The bracket 2 is as a whole resilient, both in a direction in the symetrical plane of the user and in a direction perpendicular thereto, particularly on the upper front. This not only ensures that the tanga garment 22 (see FIG. 2), that is held under tension by means of elastic band 24 attached thereto, is at all times nice and tight when put on to the user's body. Moreover, a force can be exerted herewith to the securing part 4, and in particular to the head part 18 thereof, in a direction in the symetrical plane of the user. Through this the force with which the surface 19 indirectly presses against the prostrate gland and the force with which the surface 21 indirectly presses against the musculus levator ani, respectively, can be adjusted by the user to suit his personal needs.

Due to the resilience of the bracket portions 3, 23, during walking and other rhythmic movements the securing part 4 will move back and forth slightly, as a result which the head part 18 has a massaging effect on the rectum wall and on the prostrate gland and musculus levator ani which rests against it.

The covering 22 shown in FIG. 2 can easily be substituted by a similar covering with another pattern or colour. The covering 22 is thereby arranged around the bracket 2 in the manner of a fitted sheet. It is also appealing that the rear bracket part 23 has a form which makes it possible to secure accessories such as ornaments, plumes or tails and the like for amusment purposes.

The front bracket portion 3 offers the possibility of fixing all sorts of objects or coverings, such as artifical genital organs. The wearer of the device can thus suggest the presence of other e.g. male genital organs or organs larger than the actual genital organs, either covered or not covered by fabric.

The wire parts 5, 6 can be bent in a plane perpendicular to the symetrical plane of the user in such a way that they form a support surface for the testes of a male user, so that the bulge in the briefs is enlarged. By this the user also has a more pleasant sensation. This sensation can be enhanced still more by forming the wire portions 5, 6 in such a way that they also apply a sideward pressure to the lower area of the testes, as a result of which the blood pressure in the corpus spongiosum is heightened.

The bracket portions 3 and/or 23 can be formed in such a way that the wire portions can come to rest on places on the user's body which are suitable for acupuncture treatment. The bracket can easily be adjusted to produce pressure forces necessary for that, all the more because the bracket of the device does not have to produce the otherwise necessary clamping forces as the securing part 4 substantially takes care of holding the device in place on the body. Thus the wire portions 7, 8 and/or 13 can be formed so as to press on to the os coccygis (Chang-chi'i-ang) or even to press underneath the processus spinosus of the second vertebra lumbalis (Ming-Men).

What is claimed is:

1. Device for holding an object in front of the pubic area of a user, comprising, first carrier means which includes groin-engaging portions for engaging the groin area of the user on both sides of the pubic area, and securing means for engaging the proximal side of the sphincter of the user so as to thereby be secured into place, said securing means being substantially rigidly connected to the groin-engaging portions of the first carrier means.

2. Device according to claim 1, having second carrier means (2, 23) for engaging the area of the anal cleft near the os coccygis, said second carrier means being connected to said first carrier means at the position of the securing means (4).

3. Device according to claim 2, wherein the second carrier means (2, 23) includes portions (13) for engaging the area near the os sacrum.

4. Device according to claim 2, wherein the second carrier means (2, 23) are connected to the securing means (4) in a substantially rigid manner.

5. Device according to claim 2, having a symmetrical plane, wherein at least one of the first carrier means (2,3) and the second carrier means (2,23) is elastically deformable in the symmetrical plane of the device.

6. Device according to claim 2, wherein the first carrier means (2, 3) and the second carrier means (2, 23) are integral with one another.

7. Device according to claim 6 wherein the first carrier means and the second carrier means are formed of a metal wire.

8. Device according to claim 1, wherein the first carrier means (2, 3) includes two rod shaped parts (5, 6) extending on both sides of the pubic area, which can be biased in a direction turned away from each other.

9. Device according to claim 1, wherein the securing means (4) includes a base attached to the first carrier means (2,3), a head part (18) provided with surfaces (20) for engaging the proximal side of the sphincter, and a shaft (17) connecting the base with the head part (18).

10. Device according to claim 9, including pressing means for indirectly pressing against the musculus elevator ani, said pressing means including surfaces on the head part.

11. Device according to claim 9, including pressing means for indirectly pressing against the prostate gland, said pressing means including surfaces on the head part.

12. Device according to claim 1, including a cover mounted on said first carrier means to form a strapless brief which covers the front of a pubic area of a user.

13. Device according to claim 1, wherein said carrier means is provided with pressure means for acupuncture purposes.

14. A device (1) to be worn on the body of a user, comprising, a continuous substantially rigid element (2) shaped into first and second members (3, 23) for respectively engaging the groin area of a user on both sides of a user's pubic area, and securing means (4) for engaging the proximal side of the sphincter of the user so as to thereby be secured into place, said securing means being substantially rigidly connected to said substantially rigid element to hold said first and second members against the groin area of a user on both sides of a user's pubic area.

15. Device according to claim 14, having carrier means (2, 23) for engaging the area of the anal cleft near the os coccygis, said carrier means being connected to said substantially rigid element at the position of the securing means (4).

16. Device according to claim 15, wherein the carrier means (2, 23) includes portions (13) for engaging the area near the os sacrum.

17. Device according to claim 15, wherein the carrier means (2, 23) are connected to the securing means (4) in a substantially rigid manner.

18. Device according to claim 15, wherein the substantially rigid element (2, 3) and the carrier means (2, 23) are integral with one another.

19. Device according to claim 18 wherein the substantially rigid element and the second carrier means are formed of a metal wire.

20. Device according to claim 14, having a symmetrical plane, wherein at least one of the substantially rigid element (2,3) and the carrier means (2,23) is elastically deformable in the symmetrical plane of the device.

21. Device according to claim 14, wherein the substantially rigid element (2, 3) includes two rod shaped parts (5, 6) extending on both sides of the pubic area, which can be biased in a direction turned away from each other.

22. Device according to claim 14, wherein the securing means (4) includes a base attached to the substantially rigid element (2,3), a head part (18) provided with surfaces (20) for engaging the proximal side of the sphincter, and a shaft (17) connecting the base with the head part (18).

23. Device according to claim 22, including pressing means for indirectly pressing against the musculus elevator ani, said pressing means including surfaces on the head part.

24. Device according to claim 22, including pressing means for indirectly pressing against the prostate gland, said pressing means including surfaces on the head part.

25. Device according to claim 14, including a cover mounted on said first carrier means to form a strapless brief which covers the front of a pubic area of a user.

26. Device according to claim 14, wherein at least one of said carrier means is provided with pressure means for acupuncture purposes.

27. Device (1) for holding a cover in front of the pubic area of a user, comprising, first carrier means (2, 3) for engaging the groin area of the user on both sides of the pubic area and for supporting a cover (22), and securing means (4) for engaging the proximal side of the sphincter of the user so as to thereby be secured into place, wherein the securing means is substantially rigidly connected to the first carrier means, and a cover mounted on said first carrier means to form a strapless brief which covers the front of a pubic area of a user.

28. Device according to claim 27, having second carrier means (2,23) for engaging the area of the anal cleft near the os coccygis, said second carrier means being connected to said first carrier means at the position of the securing means (4).

29. Device according to claim 28, wherein the second carrier means (2, 23) includes portions (13) for engaging the area near the os sacrum.

30. Device according to claim 28, wherein the second carrier means (2, 23) are connected to the securing means (4) in a substantially rigid manner.

31. Device according to claim 28, having a symmetrical plane, wherein at least one of the first carrier means (2,3) and the second carrier means (2,23) is elastically deformable in the symmetrical plane of the device.

32. Device according to claim 28, wherein the first carrier means (2, 3) and the second carrier means (2, 23) are integral with one another.

33. Device according to claim 32 wherein the first carrier means and the second carrier means are formed of a metal wire.

34. Device according to claim 27, wherein the first carrier means (2, 3) includes two rod shaped parts (5, 6) extending on both sides of the pubic area, which can be biased in a direction turned away from each other.

35. Device according to claim 27, wherein the securing means (4) includes a base attached to the first carrier means (2,3), a head part (18) provided with surfaces (20) for engaging the proximal side of the sphincter, and a shaft (17) connecting the base with the head part (18).

36. Device according to claim 35, including pressing means for indirectly pressing against the musculus elevator ani, said pressing means including surfaces on the head part.

37. Device according to claim 35, including pressing means for indirectly pressing against the prostate gland, said pressing means including surfaces on the head part.

38. Device according to claim 27, including a cover mounted on said first carrier means to form a strapless brief which covers the front of a pubic area of a user.

39. Device according to claim 27, wherein at least one of said carrier means is provided with pressure means for acupuncture purposes.

* * * * *